US007917976B1

(12) United States Patent
Shamie et al.

(10) Patent No.: US 7,917,976 B1
(45) Date of Patent: Apr. 5, 2011

(54) STATIONARY SIDE RAIL ASSEMBLING STRUCTURE

(75) Inventors: Sam I. Shamie, Brooklyn, NY (US); Francisco J. Reyes, Brooklyn, NY (US)

(73) Assignee: Delta Enterprise Corp., New York, NY (US)

( * ) Notice: Subject to any disclaimer, the term of this patent is extended or adjusted under 35 U.S.C. 154(b) by 56 days.

(21) Appl. No.: 12/416,238

(22) Filed: Apr. 1, 2009

(51) Int. Cl.
*A47D 7/00* (2006.01)
*A47D 13/06* (2006.01)

(52) U.S. Cl. ..... 5/93.1; 5/93.2; 5/100; 5/428

(58) Field of Classification Search ..... 5/11, 100, 5/93.1, 93.2, 207, 208, 428; 403/363, 379.5, 403/382, 403, 231
See application file for complete search history.

(56) References Cited

U.S. PATENT DOCUMENTS 4,530,528 A * 7/1985 Shamie ..... 5/100
4,706,312 A * 11/1987 Shamie ..... 5/93.1
6,167,580 B1 * 1/2001 Draheim et al. ..... 5/100
6,175,974 B1 * 1/2001 Draheim ..... 5/100
7,752,689 B1 * 7/2010 Shamie et al. ..... 5/100
2006/0000017 A1 * 1/2006 Hernandez ..... 5/93.1

* cited by examiner

*Primary Examiner* — Robert G Santos
*Assistant Examiner* — Brittany M Wilson
(74) *Attorney, Agent, or Firm* — Richard M. Goldberg

(57) ABSTRACT

A crib includes a headboard; footboard; a first stationary side rail connected between the headboard and footboard and including upper and lower rails; a second side rail connected between the headboard and footboard; pivot lock hardware including a first engagement member at ends of the upper rail member and a second engagement member at respective corner posts, each second engagement member pivotally engaged with a first engagement member to permit pivotal movement of the first stationary side rail relative to the headboard and footboard and to lock the stationary side rail relative to the headboard and footboard; and swivel lock hardware including a third engagement member at ends of the lower rail member and a fourth engagement member at respective corner posts, each fourth engagement member being pivotally engaged with a respective third engagement member to lock the stationary side rail relative to the headboard and footboard.

25 Claims, 12 Drawing Sheets

FIG. 6
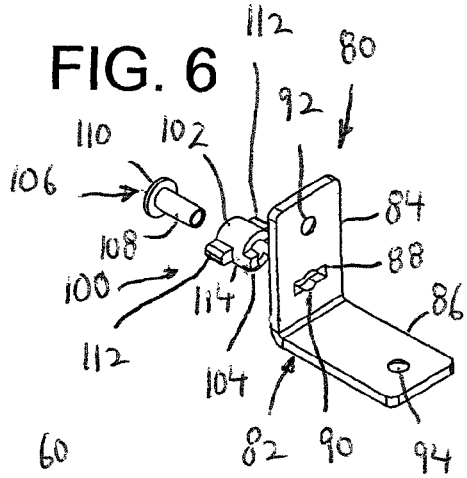
FIG. 7
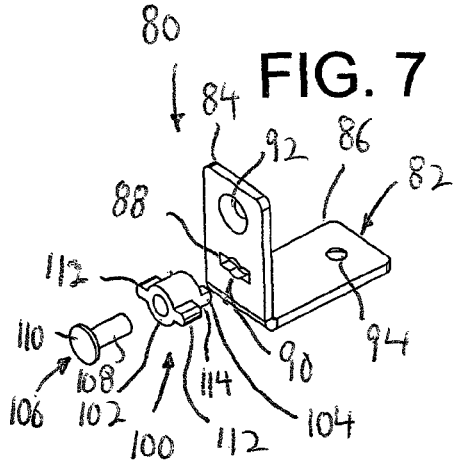
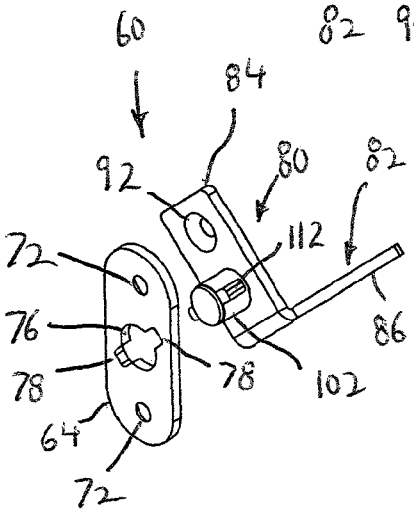
FIG. 8
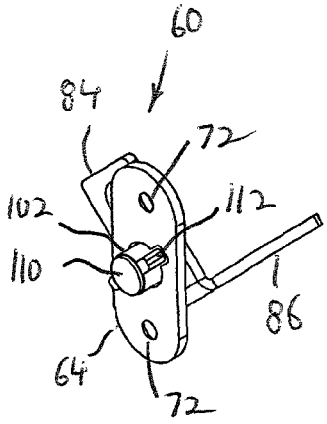
FIG. 9
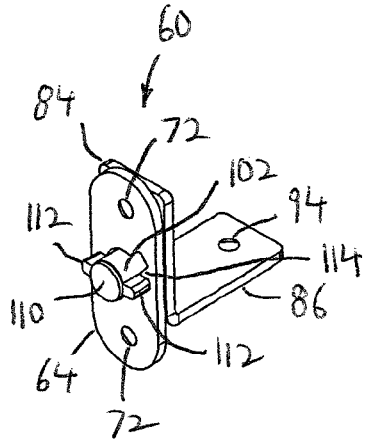
FIG. 10

STATIONARY SIDE RAIL ASSEMBLING STRUCTURE

BACKGROUND OF THE INVENTION

The present invention relates generally to infant cribs, and more particularly, is directed to a structure for safely assembling a stationary side rail without tools in a secure and foolproof manner.

Generally, in cribs, one or both side rails are fixed or stationary. In some cribs, one side rail, called a drop side rail, can be slid vertically between an upper closed position and a lower open position to aid in the removal of the child from the crib or for placing the child in the crib. At a recent industry convention, it was proposed to make both side rails permanent and eliminate the drop side nature of one side rail entirely.

Generally, each stationary side rail is secured to the corner posts of the headboard or sideboard in any suitable manner, such as screws or the like. This, however, becomes burdensome for the consumer to assemble the stationary side rail. Alternatively, the stationary rail can be secured to the corner posts of the headboard and footboard in the manner disclosed in applicant's copending U.S. patent application Ser. No. 11/862,919, filed Sep. 27, 2007, the entire disclosure of which is incorporated herein by reference.

In addition, in conventional structures, in order to disassemble the crib for storage, screws must be removed and can get lost. Also, the federal standard requires that the screws need to be machine screws, and not wood screws. However, machine screws tend to loosen over time as the child shakes the crib and jumps in the crib.

It is therefore desirable to provide a safe, secure and foolproof way of assembling the stationary side rails, without the use of any tools.

SUMMARY OF THE INVENTION

Accordingly, it is an object of the present invention to provide a structure for assembling a stationary side rail of a crib that overcomes the aforementioned problems.

It is another object of the present invention to provide a structure for assembling a stationary side rail without tools.

It is still another object of the present invention to provide a structure for assembling a stationary side rail that utilizes a pivoting action of the side rail during assembly.

It is yet another object of the present invention to provide a structure for assembling a stationary side rail that prevents inadvertent disassembly thereof.

In accordance with an aspect of the present invention, a crib includes a headboard having a pair of spaced apart corner posts; a footboard having a pair of spaced apart corner posts; a first stationary side rail connected between a first one of the corner posts of the headboard and a first one of the corner posts of the footboard, the first stationary side rail including an upper rail section and a lower rail section; and a second side rail connected between a second one of the corner posts of the headboard and a second one of the corner posts of the footboard. Locking hardware is provided for securing one or both of the upper rail member and lower rail member to the first corner posts of the headboard and footboard. The locking hardware includes a first engagement member at each end of either a respective rail member, or respective corner posts. The locking hardware also includes a second engagement member at the other of each end of either the respective rail member, or the respective corner posts. Each second engagement member is pivotally engaged with a respective first engagement member to releasably lock the stationary side rail relative to the headboard and footboard.

In one embodiment, the locking hardware includes pivot lock hardware which permits pivotal movement of the first stationary side rail relative to the headboard and footboard and which releasably locks the stationary side rail relative to the headboard and footboard when the stationary rail, headboard and footboard are all in a vertical orientation.

Preferably, the first engagement member includes a plate having a keyed guide, and the second engagement member includes a male key head assembly which engages with the keyed guide. Specifically, the keyed guide includes a keyed female opening in the plate, and the male key head assembly engages within the keyed female opening.

The keyed female opening includes a central opening in the plate and at least one wing opening in the plate in communication with the central opening. The male key head assembly includes a main body member for rotatably engaging within the central opening and at least one wing member connected with the main body member for engaging within the wing opening to a position behind the plate to permit the pivotal movement of the first stationary side rail relative to the headboard and footboard and to releasably lock the stationary side rail relative to the headboard and footboard when the stationary rail, headboard and footboard are all in a vertical orientation. The second engagement member also includes a securing member for securing the main body and the at least one wing member to each end of a respective rail member, and the plate is secured to the respective corner posts in covering relation to a bore in the respective corner posts.

Preferably, there are two diametrically opposite wing openings and two diametrically opposite wing members. Also, the at least one wing opening and the at least one wing member are oriented at different angles relative to each other when the stationary rail, headboard and footboard are all in a vertical orientation.

In a second embodiment, the locking hardware includes swivel lock hardware. In such case, the first engagement member includes a plate having an arcuate guide, and the second engagement member includes a male key head assembly pivotally mounted relative to the other of each end of either the respective rail member, or the respective corner posts. The male key head assembly includes a pivotal engagement member which engages in a first initial position with the arcuate guide when the first and second engagement members are initially engaged, and which engages in a second locking position with the arcuate guide when the male key head assembly is pivotally moved relative to the other of each end of either the respective rail member, or the respective corner posts, to releasably lock the stationary side rail to the headboard and footboard.

Specifically, the arcuate guide includes a female plate having an arcuate slot with an enlarged opening at one portion thereof corresponding to the first initial position, and the pivotal engagement member includes a swivel plate pivotally mounted to the other of each end of either the respective rail member, or the respective corner posts. A pin with an enlarged head that fits within the arcuate slot is secured to the swivel plate and extends behind the female plate.

The female plate also includes a pivot opening adjacent the enlarged opening, and the pivotal engagement member includes a pivot pin that extends through the pivot opening and about which the pivotal engagement member is pivoted relative to the other of each end of either the respective rail member, or the respective corner posts. The female plate also includes a locking opening, and the pivotal engagement member includes a spring biased button for releasably engaging within the locking opening in the second locking position. Further, there is a finger grasp member connected with the swivel plate to enable the pivoting movement of the swivel plate.

In accordance with another aspect of the present invention, a crib includes a headboard having a pair of spaced apart corner posts; a footboard having a pair of spaced apart corner posts; a first stationary side rail connected between a first one of the corner posts of the headboard and a first one of the corner posts of the footboard, the first stationary side rail including an upper rail section and a lower rail section; and a second side rail connected between a second one of the corner posts of the headboard and a second one of the corner posts of the footboard. Pivot lock hardware is provided for securing the upper rail member or lower rail member to the first corner posts of the headboard and footboard. The pivot locking hardware includes a first engagement member at either each end of either a respective rail member, or respective corner posts, and a second engagement member at the other of either each end of either the respective rail member, or the respective corner posts. Each second engagement member is pivotally engaged with a respective first engagement member to permit pivotal movement of the first stationary side rail relative to the headboard and footboard and to releasably lock the stationary side rail relative to the headboard and footboard when the stationary rail, headboard and footboard are all in a vertical orientation. Swivel lock hardware is also provided for securing the other of either the upper rail member and lower rail member to the first corner posts of the headboard and footboard. The swivel lock hardware includes a third engagement member at one of either each end of either a respective rail member, or respective corner posts, and a fourth engagement member at the other of either each end of either the respective rail member, or the respective corner posts. Each fourth engagement member is pivotally engaged with a respective third engagement member to releasably lock the stationary side rail relative to the headboard and footboard.

The above and other objects, features and advantages of the invention will become readily apparent from the following detailed description thereof which is to be read in connection with the accompanying drawings.

BRIEF DESCRIPTION OF THE DRAWINGS

FIG. 6 is an exploded, rear perspective view of the key head assembly of the keyed pivot lock assembling hardware;

FIG. 7 is an exploded, front perspective view of the key head assembly of the keyed pivot lock assembling hardware;

FIG. 8 is a perspective view, showing the first step of assembly of the key head assembly with the female plate of the keyed pivot lock assembling hardware;

FIG. 9 is a perspective view, showing the second step of assembly of the key head assembly with the female plate of the keyed pivot lock assembling hardware;

FIG. 10 is a perspective view, showing the third and final step of assembly of the key head assembly with the female plate of the keyed pivot lock assembling hardware in a locked condition;

DETAILED DESCRIPTION

Figure 1:
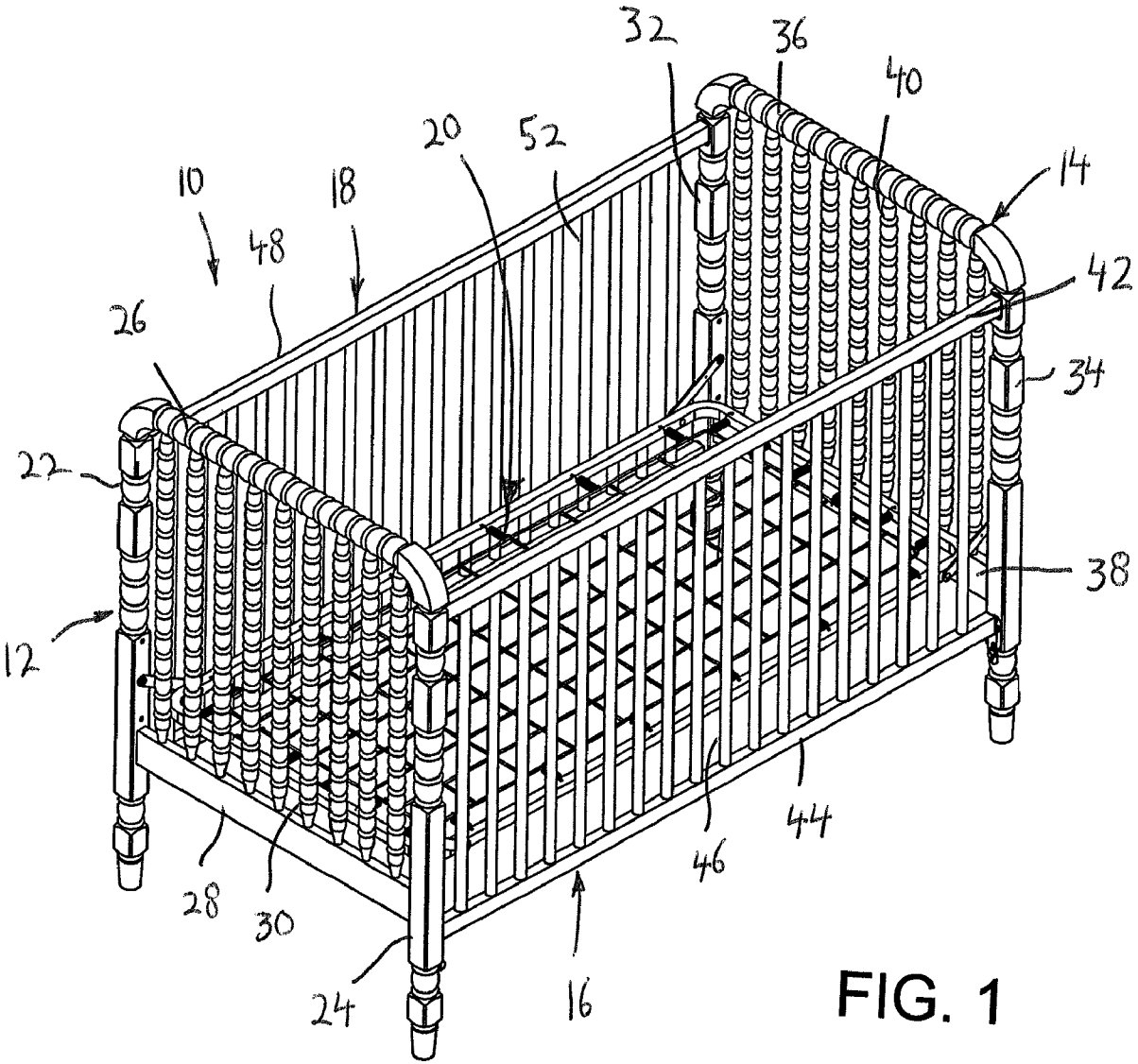
FIG. 1 is a front perspective view of the crib according to the present invention, with two stationary side rails.
Figure 3:
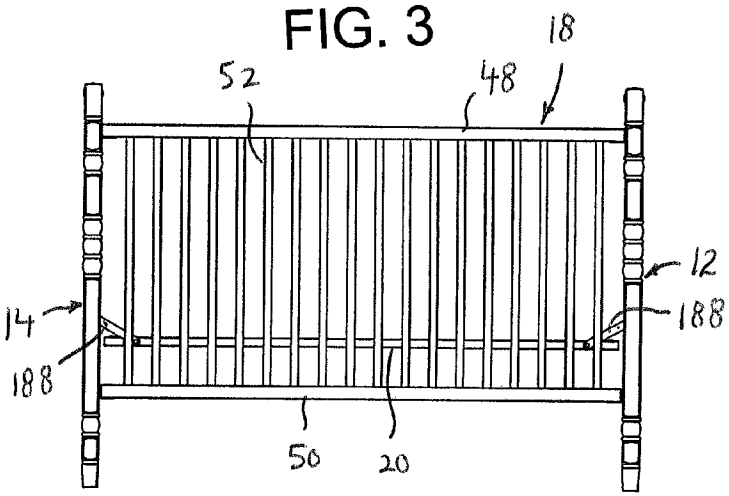
FIG. 3 is a rear elevational view of the crib of FIG. 1.
Figure 5:
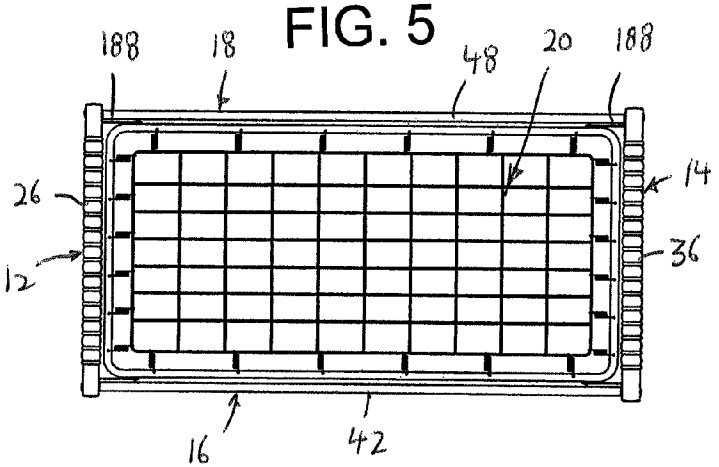
FIG. 5 is a top plan view of the crib of FIG. 1.
Figure 2:
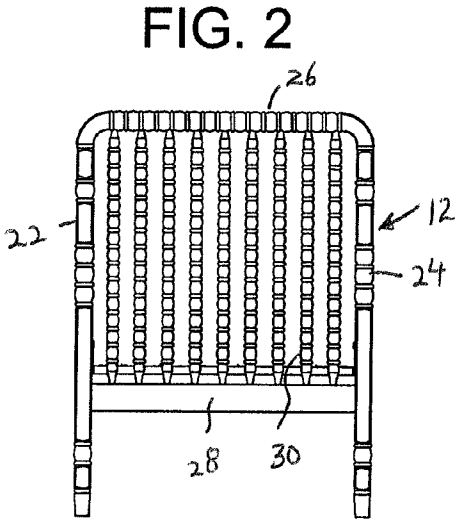
FIG. 2 is a left side elevational view of the crib of FIG. 1.
Figure 4:
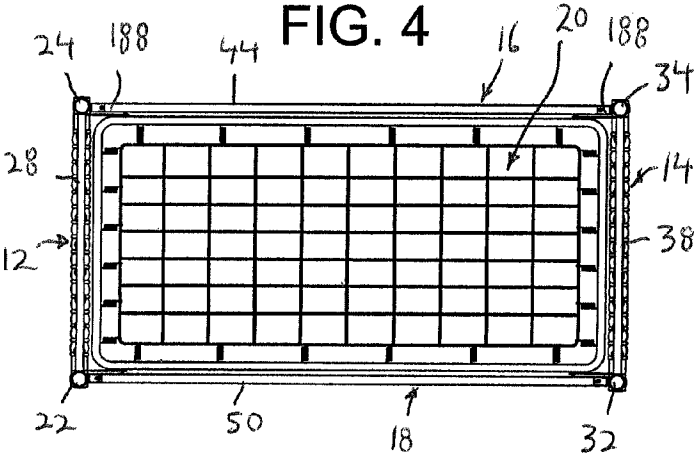
FIG. 4 is a bottom plan view of the crib of FIG. 1.
Figure 14:
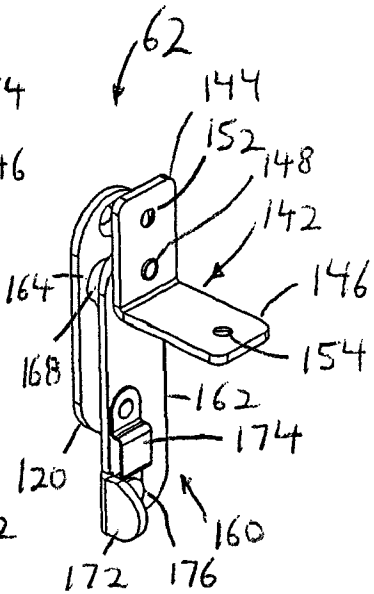
FIG. 14 is a rear perspective view, showing the third step of assembly of the swivel lock bottom assembling hardware in a locked condition.
Figure 13:
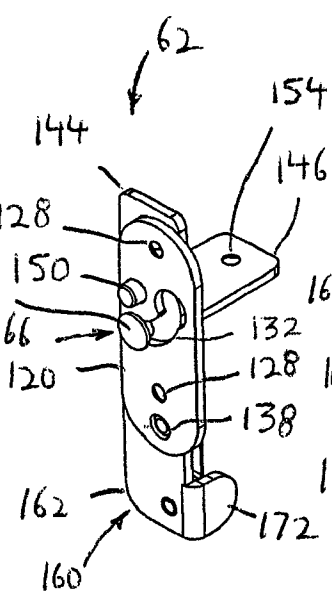
FIG. 13 is a front perspective view, showing the third step of assembly of the swivel lock bottom assembling hardware in a locked condition.
Figure 12:
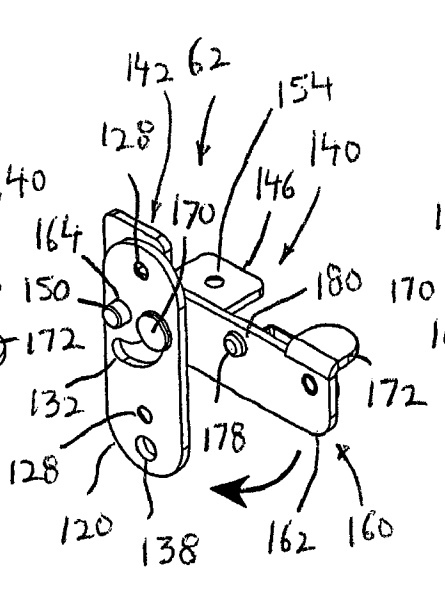
FIG. 12 is a perspective view, showing the second step of assembly of the swivel lock bottom assembling hardware.
Figure 11:
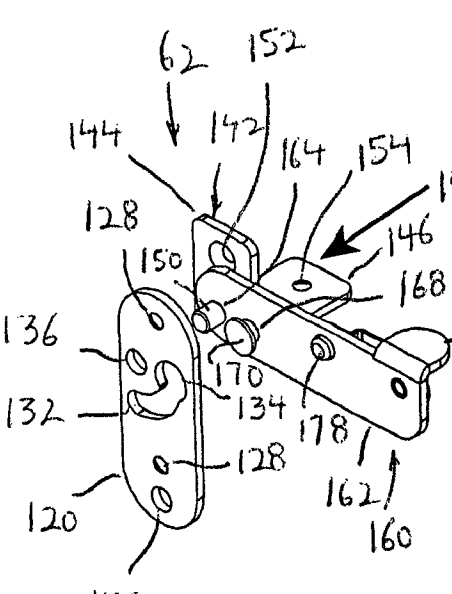
FIG. 11 is a perspective view, showing the first step of assembly of the swivel lock bottom assembling hardware.
Figure 20:
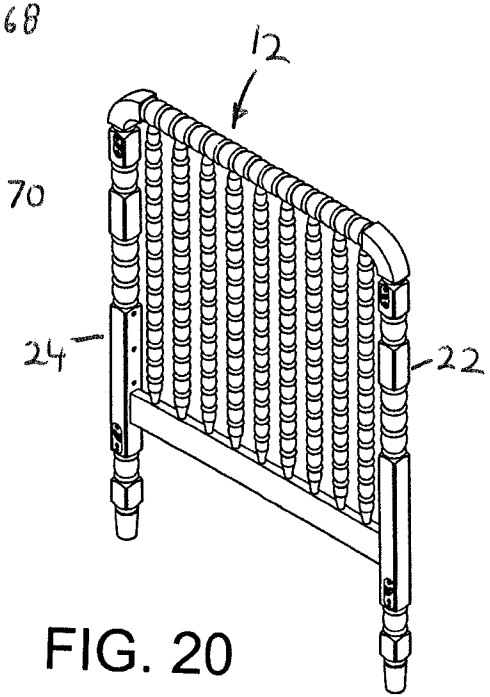
FIG. 20 is a perspective view of the headboard, with the female elements of the assembling hardware shown assembled therewith.
Figure 17:
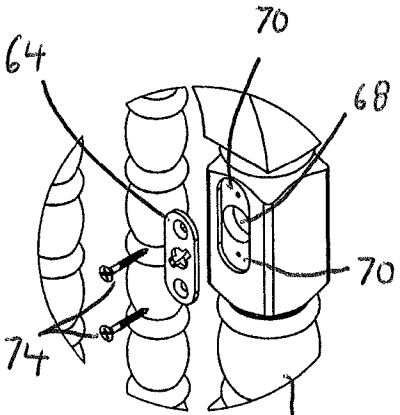
FIG. 17 is an enlarged perspective view of the upper end of the inner face of the other corner post of the headboard, with the female element of the key head assembly shown in an exploded state.
Figure 19:
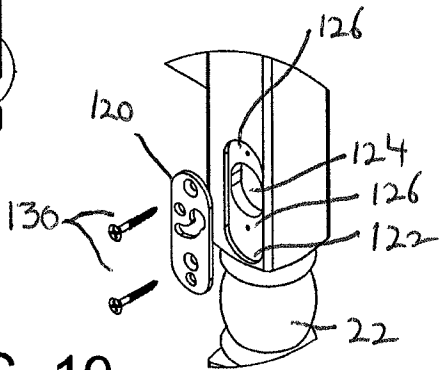
FIG. 19 is an enlarged perspective view of the lower end of the inner face of the other corner post of the headboard, with the female element of the swivel lock bottom assembling hardware shown in an exploded state.
Figure 15:
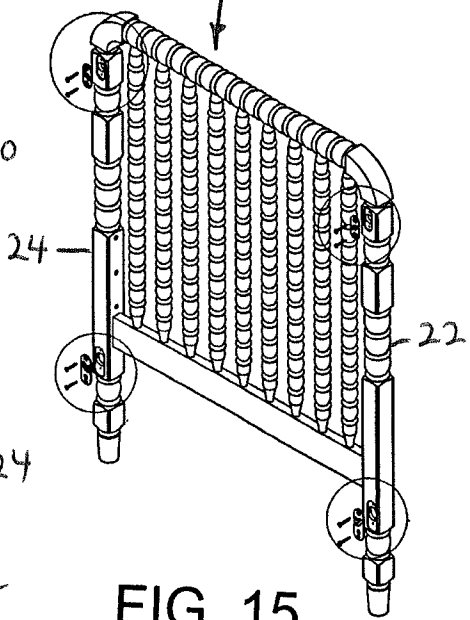
FIG. 15 is a perspective view of the headboard, with the female elements of the assembling hardware shown in an exploded state.
Figure 16:
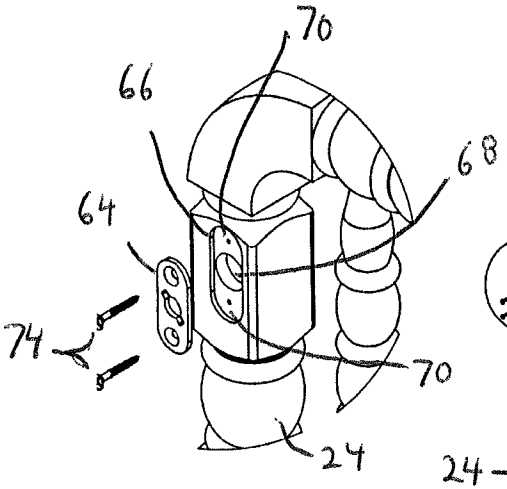
FIG. 16 is an enlarged perspective view of the upper end of the inner face of one corner post of the headboard, with the female element of the key head assembly shown in an exploded state.
Figure 18:
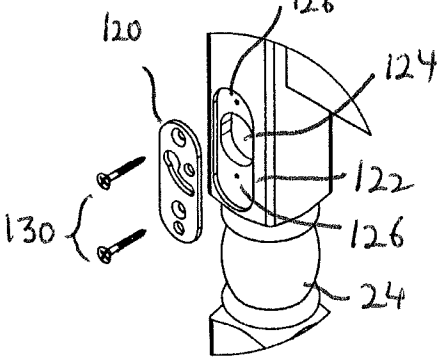
FIG. 18 is an enlarged perspective view of the lower end of the inner face of the one corner post of the headboard, with the female element of the swivel lock bottom assembling hardware shown in an exploded state.

Referring to the drawings in detail, and initially to FIGS. 1-5 thereof, a crib 10 according to the present invention includes a headboard 12 and a footboard 14 connected together in a parallel, spaced apart relation to each other. Headboard 12 and footboard 14 are connected together by stationary side rails 16 and 18, and a spring deck 20 is mounted within the area enclosed by headboard 12, footboard 14 and stationary side rails 16 and 18 for supporting a mattress (not shown) thereon.

Headboard 12 is formed by two parallel, spaced apart posts 22 and 24 which form corner posts for crib 10. Posts 22 and 24 are connected at their upper ends by a horizontally oriented upper cross brace 26 and are connected at positions approximately one-quarter of the length thereof measured from the lower ends by a horizontally oriented lower cross brace 28. A plurality of equidistantly spaced apart vertical slats or rods 30 interconnect upper cross brace 26 and lower cross brace 28.

In like manner, footboard 14 is formed by two parallel, spaced apart posts 32 and 34 which form corner posts for crib 10. Posts 32 and 34 are connected at their upper ends by a horizontally oriented upper cross brace 36 and are connected at positions approximately one-quarter of the length thereof measured from the lower ends by a horizontally oriented lower cross brace 38. A plurality of equidistantly spaced apart vertical slats or rods 40 interconnect upper cross brace 36 and lower cross brace 38.

Stationary rail 16 includes an upper rail member 42 and a substantially parallel, spaced apart lower rail member 44 connected together by plurality of equidistantly spaced apart vertical slats or rods 46, while stationary rail 18 includes an upper rail member 48 and a substantially parallel, spaced apart lower rail member 50 connected together by plurality of equidistantly spaced apart vertical slats or rods 52.

The securement of stationary side rails 16 and 18 to headboard 12 and footboard 14 will now be discussed.

Specifically, keyed pivot lock hardware 60 is provided for connecting upper rail members 42 and 48 to headboard 12 and footboard 14, while swivel lock hardware 62 is provided for connecting lower rail members 44 and 50 to headboard 12 and footboard 14.

As shown best in FIGS. 6-10, 15-17 and 20-23, pivot lock hardware 60 includes female plates 64 which fit snugly within recesses 66 of the same shape and dimensions in the upper inner face of each corner post 22, 24, 32, 34. Although female plates 64 and recesses 66 are shown to have an elongated shape with rounded ends, the present invention is not limited thereby, and any suitable shape can be provided. Each recess 66 includes a central bore 68 and two smaller holes 70 on opposite sides of central bore 68. Each female plate 64 includes two openings 72 in alignment with holes 70 when the female plate 64 is positioned in recess 66 for receiving screws 74 that secure female plate 64 in the respective recess 66, as shown best in FIGS. 20 and 28. Each female plate 64 further includes a keyed female opening comprised of a central opening 76 in alignment with central bore 68 and two diametrically opposite wing openings 78 in communication with central opening 76, as best shown in FIG. 8. The outer diameter of an imaginary circle circumscribing the outer ends of wing openings 78 corresponds to the diameter of central bore 68. When a female plate 64 is secured in a recess 66, the exposed face of female plate 64 seats flush with the inner face of the respective corner post 22, 24, 32, 34, as shown best in FIG. 28. Further, when so secured in a recess 66, wing openings 78 extend at an angle of about 45 degrees from vertical, the purpose for which will be understood from the description which follows. However, the present invention is not limited to this angular orientation, and wing openings 78 can extend along any angle other than zero degrees horizontal.

Figure 23:
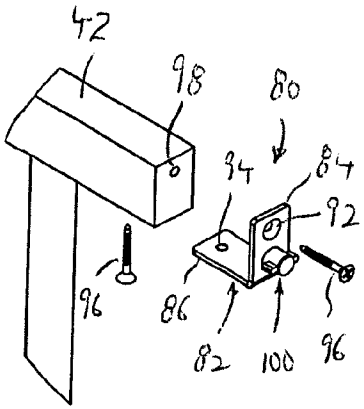
FIG. 23 is an enlarged perspective view of the other end of the upper rail of the stationary side rail, with the male element of the key head assembly shown in an exploded state.
Figure 21:
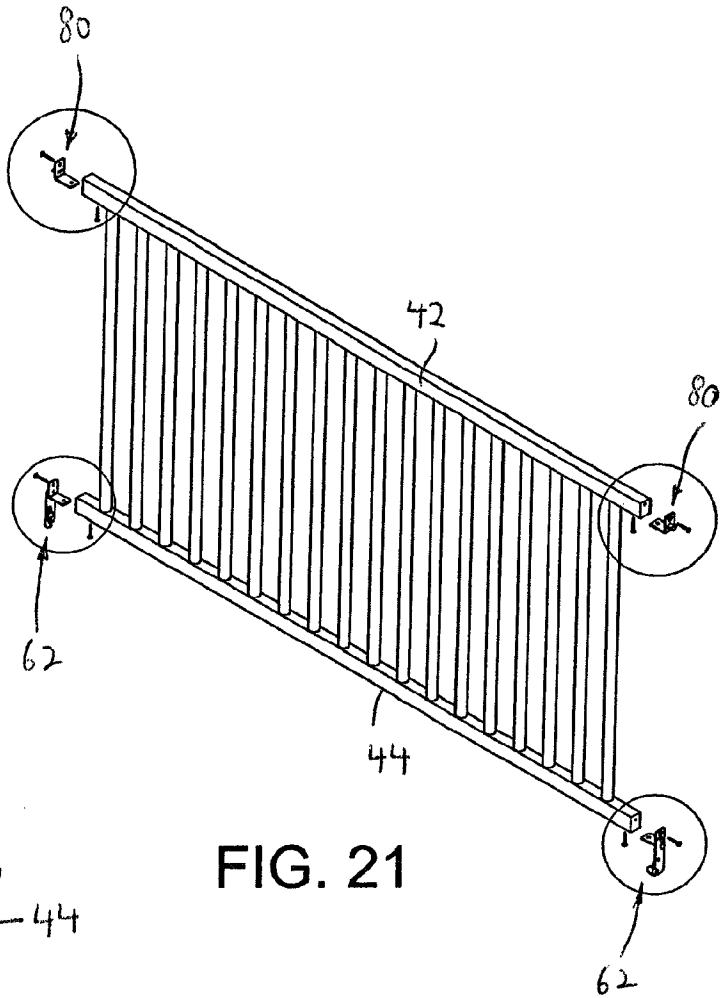
FIG. 21 is a perspective view of one stationary side rail, with the male elements of the assembling hardware shown in an exploded state.
Figure 22:
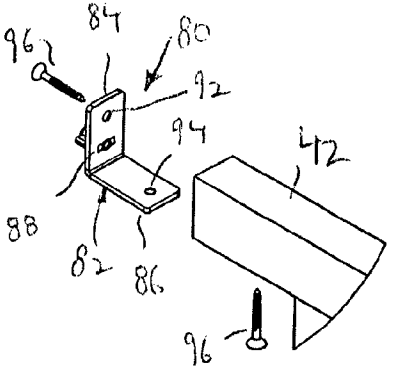
FIG. 22 is an enlarged perspective view of one end of the upper rail of the stationary side rail, with the male element of the key head assembly shown in an exploded state.

As shown best in FIGS. 6-10, 15 and 18-20, pivot lock hardware 60 further includes a male key head assembly 80 formed by an L-shaped plate 82 having a first vertically oriented leg plate 84 and a second horizontally oriented leg plate 86 connected at a right angle with leg plate 84. A horizontally oriented slot 88 is formed at a lower portion of vertically oriented leg plate 84 and includes an enlarged opening portion 90 at the center thereof. In addition, vertically oriented leg plate 84 includes an opening 92 near the free end thereof and horizontally oriented leg plate 86 includes an opening 94 near the free end thereof to secure each L-shaped plate 82 to the end of a respective upper rail member 42, 48 by screws 96, as shown in FIGS. 21-23. In this position, horizontally oriented leg plate 86 is positioned against the undersurface of a respective upper rail member 42, 48 and vertically oriented leg plate 84 is positioned against an end face of the respective upper rail member 42, 48. The end face and undersurface of the respective upper rail member 42, 48 is preferably provided with small openings 98 for receiving screws 96.

Male key head assembly 80 further includes a male key 100 formed by a hollow cylindrical member 102 having diametrically opposite projections 104 at one axial end that fit within horizontally oriented slot 88 in surrounding relation to enlarged opening portion 90. A rivet 106 has a stem 108 and an enlarged head 110 at one end, with stem 108 being force fit through cylindrical member 102 and enlarged opening portion 90 to fixedly secure male key 100 to L-shaped plate 82. Male key 100 further includes two diametrically opposite wings 112 at the opposite end of cylindrical member 102, and which correspond in shape and dimensions to wing openings 78. Wings 78 do not extend the entire axial distance along cylindrical member 102, thereby being spaced by a gap 114 from the opposite end of cylindrical member 102 by a distance equal at least to the thickness of a female plate 64.

Figure 28:
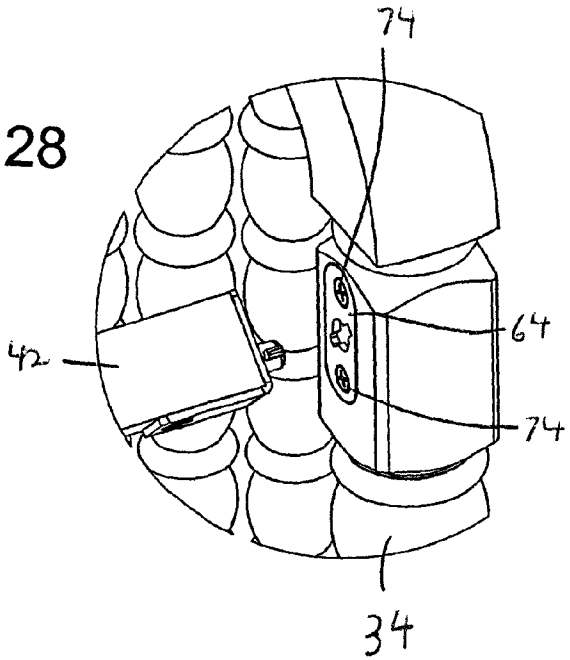
FIG. 28 is an enlarged perspective view of the other end of the upper rail and the respective upper end of the corner post of the footboard FIG. 26.
Figure 26:
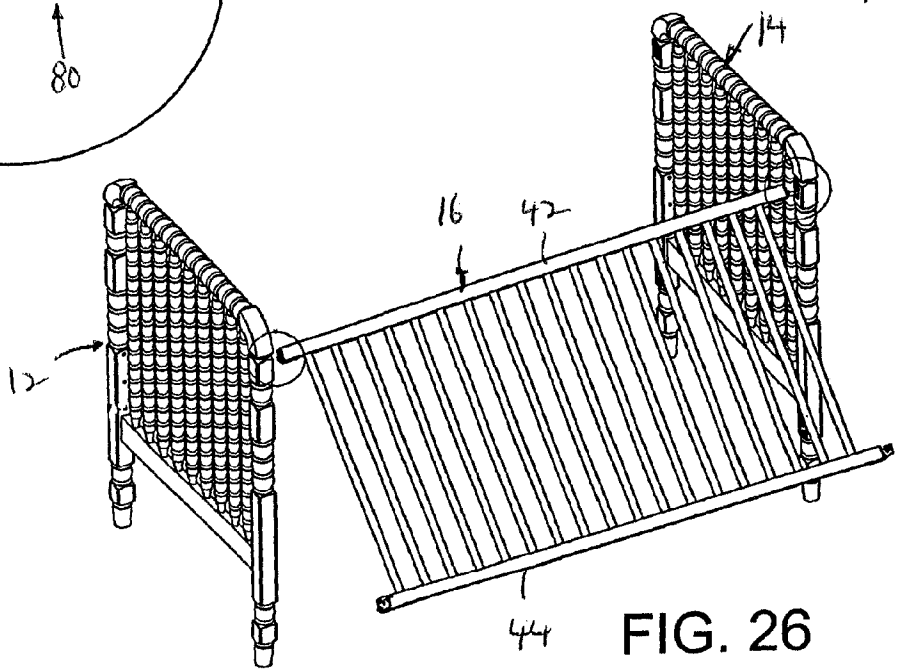
FIG. 26 is a perspective view showing a first step of connecting one stationary side rail to the upper ends of respective corner posts of the headboard and footboard, prior to engagement of the male and female elements of the key head assembly.
Figure 27:
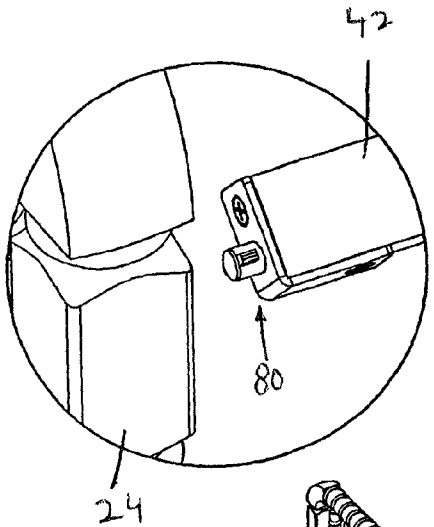
FIG. 27 is an enlarged perspective view of one end of the upper rail and the respective upper end of the corner post of the headboard of FIG. 26.

With this arrangement, male key 100 can be connected with a female plate 64. Specifically, hollow cylindrical member 102 and wings 112 are respectively fit within a central bore 76 and wing openings 78 of a respective female plate 64, until wings 112 extend behind the female plate 64 into the respective central bore 68, as shown in FIGS. 26-28. In this position, it will be appreciated that the stationary side rail 16, 18 is caused to be oriented outwardly at the same 45 degree angle as wing openings 78.

However, because wings 112 extend behind the female plate 64 into the respective central bore 68, male key 100, and stationary side rail 16 or 18 therewith, are permitted to rotate, with female plate 64 fitting within gap 114. When stationary side rail 16 or 18 is rotated down to a vertical orientation, wings 112 are no longer aligned with wing openings 78, so that wings 112 are positioned behind female plate 64, thereby locking the respective stationary side rail 16, 18 to headboard 12 and footboard 14.

This is because wings 112 are oriented at zero degrees horizontal relative to the vertical direction of stationary rails 16, 18. The present invention, however, is not limited to this angular arrangement. For example, wing openings 78 can be oriented at zero degrees horizontal and wings 112 at 45 degrees. Alternatively, both wing openings 78 and wings 112 can be oriented at an angle relative to horizontal. The only limitation is that both wing openings 78 and wings 112 are not oriented at the same angle when stationary rail 16 is in the same vertical assembled orientation as headboard 12 and footboard 14.

As a further alternative, it will be appreciate that, in plate of the keyed opening formed by central opening 76 and wing openings 78, guides can be provided on plate 64 for guiding wings 112 in the same manner.

To detach the respective stationary side rail 16, 18 to headboard 12 and footboard 14, the reverse operation is performed, and the respective stationary side rail 16, 18 is rotated up to the same 45 degree angle where wings 112 are again in alignment with wing openings 78 and can be removed.

As shown best in FIGS. 11-15, 18-21, 24 and 25, swivel lock hardware 62 includes female plates 120 which fit snugly within recesses 122 of the same shape and dimensions in the lower inner face of each corner post 22, 24, 32, 34. Although female plates 120 and recesses 122 are shown to have an elongated shape with rounded ends, the present invention is not limited thereby, and any other suitable shape can be used. Each recess 122 includes a central bore 124 and two smaller holes 126 on opposite sides of central bore 124. Each female plate 120 includes two openings 128 in alignment with holes 126 when the female plate 120 is positioned in recess 122 for receiving screws 130 that secure female plate 120 in the respective recess 122, as shown best in FIGS. 18-20. Each female plate 120 further includes an arcuate slot 132 in alignment with central bore 124, with the upper end of arcuate slot 132 having an enlarged opening 134, the purpose for which will become apparent from the description which follows. Female plate 120 further includes a pivot opening 136 adjacent the upper end of enlarged opening 134, and a lower lock opening 138. When a female plate 120 is secured in a recess 122, the exposed face of female plate 120 seats flush with the inner face of the respective corner post 22, 24, 32, 34.

Figure 25:
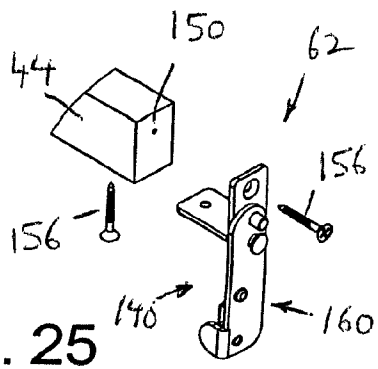
FIG. 25 is an enlarged perspective view of the other end of the lower rail of the stationary side rail, with the male element of the swivel lock bottom assembling hardware shown in an exploded state.
Figure 24:
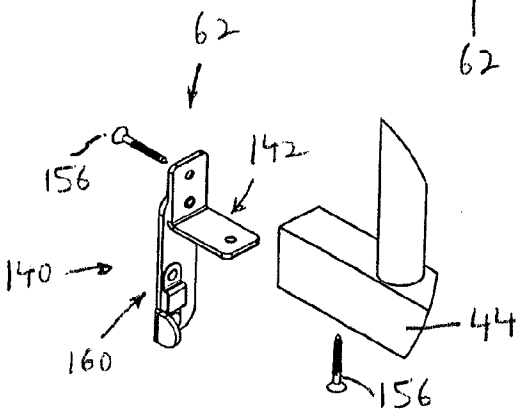
FIG. 24 is an enlarged perspective view of one end of the lower rail of the stationary side rail, with the male element of the swivel lock bottom assembling hardware shown in an exploded state.

As shown best in FIGS. 11-14, 21, 24 and 25, swivel lock hardware 62 further includes a male key head assembly 140 formed by an L-shaped plate 142 having a first vertically oriented leg plate 144 and a second horizontally oriented leg plate 146 connected at a right angle with leg plate 144. A pivot pin 150 is press fit in and extends outwardly from an opening 148 formed at a lower portion of vertically oriented leg plate 144. In addition, vertically oriented leg plate 144 includes an opening 152 near the free end thereof and horizontally oriented leg plate 146 includes an opening 154 near the free end thereof to secure each L-shaped plate 142 to the end of a respective lower rail member 44, 50 by screws 156, as shown in FIGS. 21, 24 and 25. In this position, horizontally oriented leg plate 146 is positioned against the undersurface of a respective lower rail member 44, 50 and vertically oriented leg plate 144 is positioned against an end face of the respective lower rail member 44, 50. The end face and undersurface of the respective lower rail member 44, 50 is preferably provided with small openings 158 for receiving screws 156.

Male key head assembly 140 further includes a male swivel key 160 formed by an elongated swivel plate 162 having an opening 164 at one end which is rotatably mounted on pivot pin 150. The length of swivel plate 162 is greater than that of female plate 120. A pivot guide 166 is fixed to swivel plate 162 adjacent opening 164 and is formed by a stem 168 fixed to swivel plate 162 and extending outwardly therefrom, and an enlarged head 170 fixed to the free end of stem 168. Male swivel key 160 further includes a finger grip 172 at the opposite end thereof by which a person can rotate swivel plate 162 about pivot pin 150.

Male swivel key 160 also includes a bent spring 174 which is fixed by a rivet 176 to the rear surface of swivel plate 162 at the end opposite to opening 164 and extends in a direction toward opening 164. The free end of bent spring 174 includes a button 178 that extends through an opening 180 in swivel plate 162.

Figure 31:
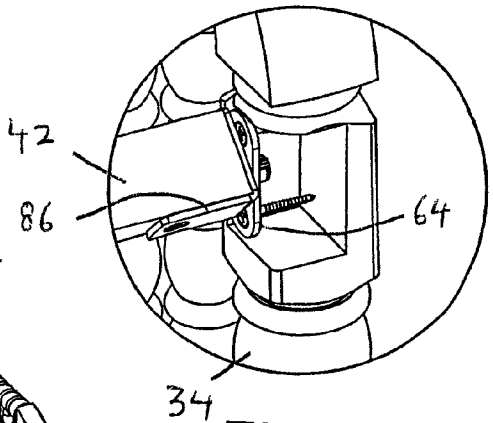
FIG. 31 is an enlarged, partially broken away, perspective view of the other end of the upper rail and the respective upper end of the corner post of the footboard FIG. 29.
Figure 29:
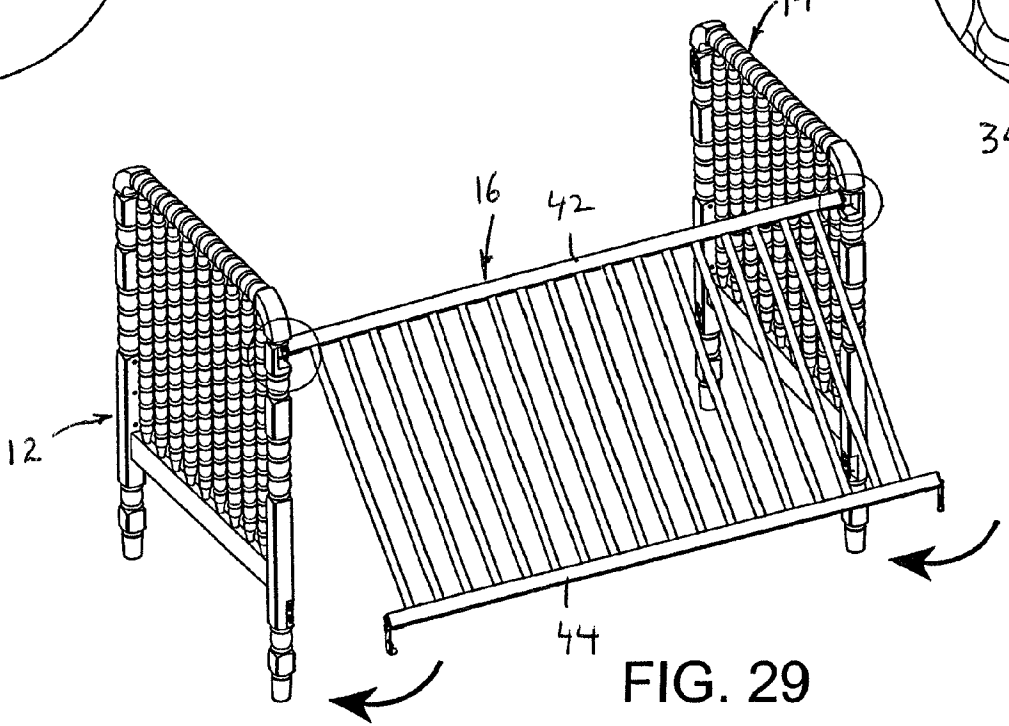
FIG. 29 is a perspective view showing a second step of connecting the one stationary side rail to the upper ends of respective corner posts of the headboard and footboard, including engagement of the male and female elements of the key head assembly while the stationary side rail is in a tilted position.
Figure 30:
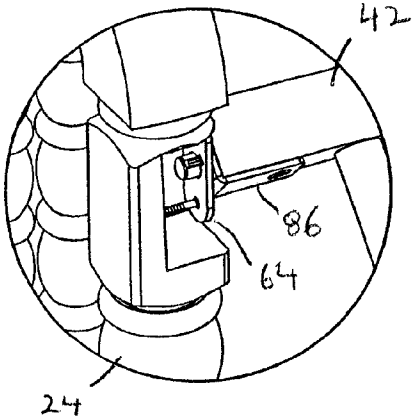
FIG. 30 is an enlarged, partially broken away, perspective view of the one end of the upper rail and the respective upper end of the corner post of the headboard of FIG. 29.
Figure 33:
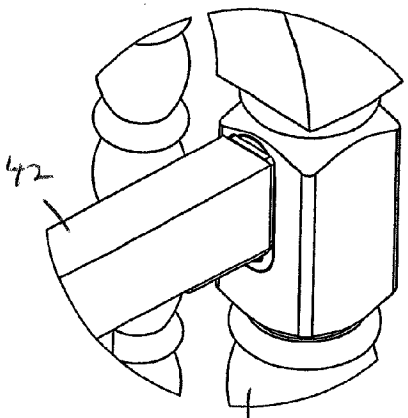
FIG. 33 is an enlarged perspective view of the other end of the upper rail and the respective upper end of the corner post of the footboard of FIG. 32.
Figure 35:
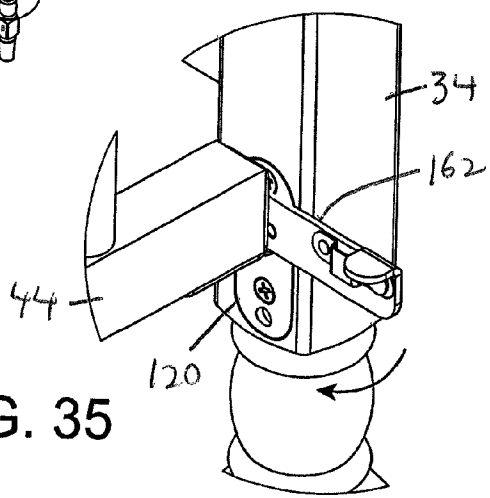
FIG. 35 is an enlarged perspective view of the other end of the lower rail and the respective lower end of the corner post of the footboard FIG. 32.
Figure 32:
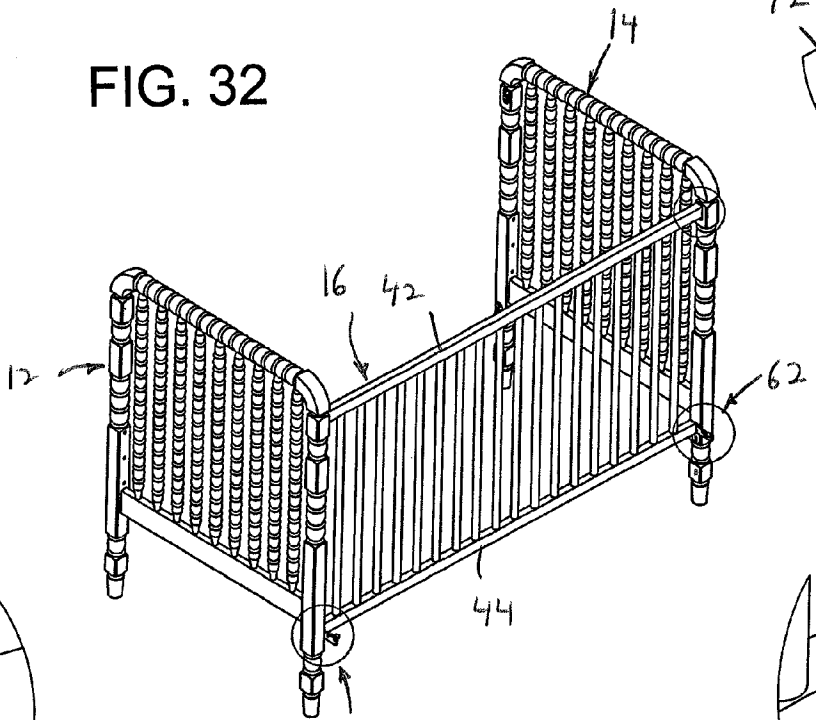
FIG. 32 is a perspective view showing a third step of connecting the one stationary side rail to the lower ends of respective corner posts of the headboard and footboard, in which the stationary side rail is pivoted about the key head assembly to a vertical orientation and with the swivel lock bottom assembling hardware connected in an unlocked state.
Figure 34:
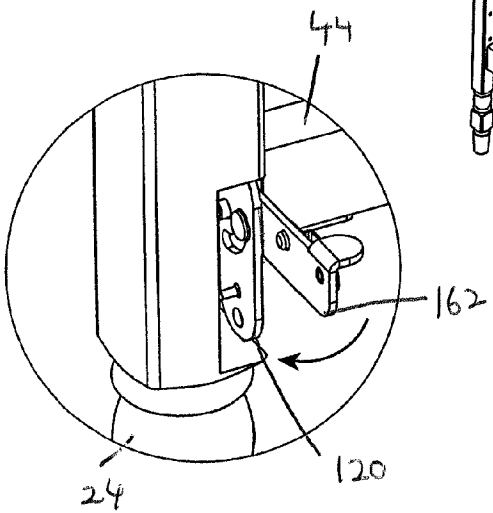
FIG. 34 is an enlarged, partially broken away, perspective view of one end of the lower rail and the respective lower end of the corner post of the headboard FIG. 32.
Figures 36, 37, 38:
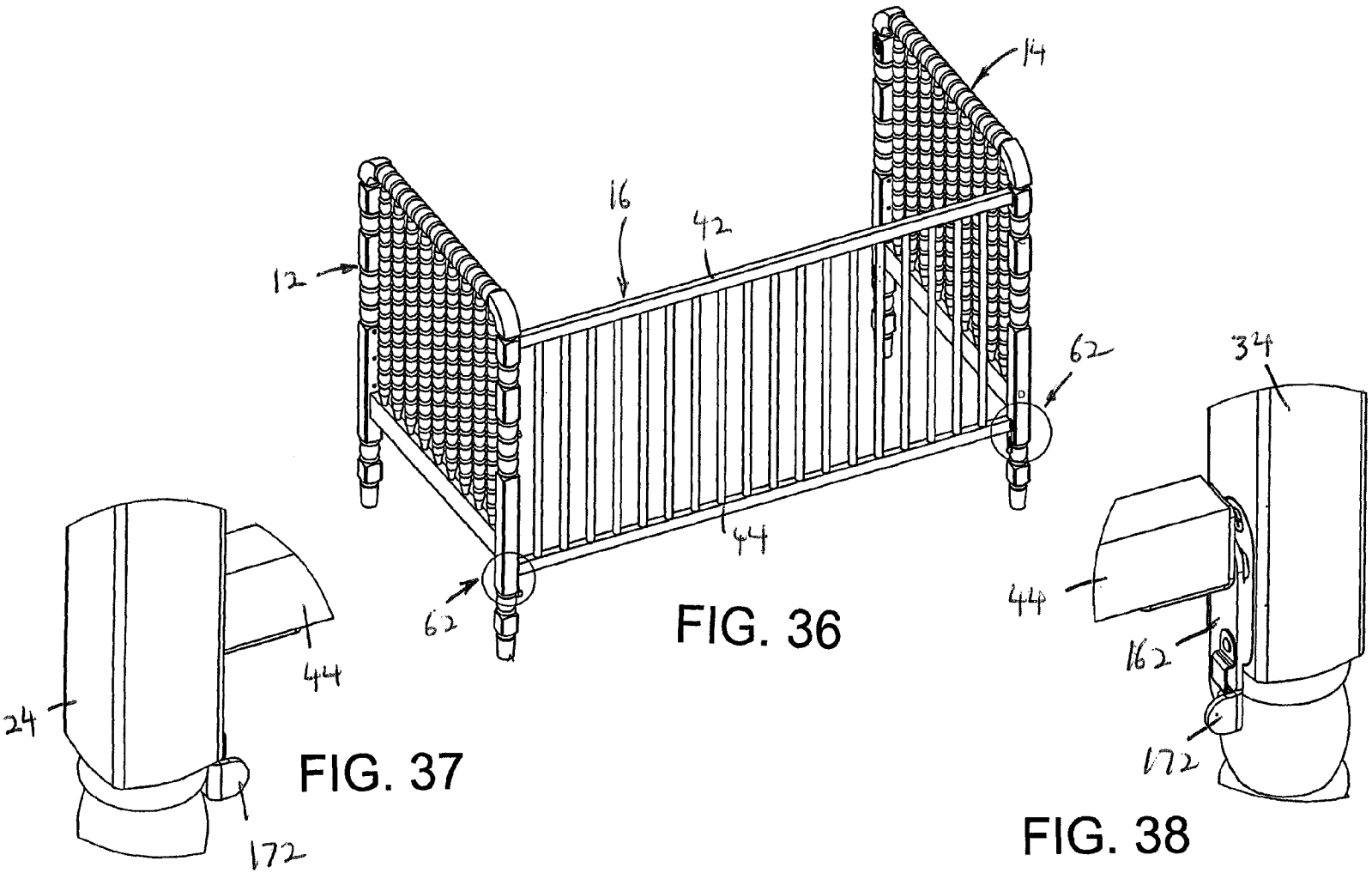
FIG. 36 is a perspective view showing a fourth step of connecting the one stationary side rail to the lower ends of respective corner posts of the headboard and footboard, in which the swivel lock bottom assembling hardware is in a locked state.
FIG. 37 is an enlarged perspective view of the one end of the lower rail and the respective lower end of the corner post of the headboard FIG. 36.
FIG. 38 is an enlarged perspective view of the other end of the lower rail and the respective lower end of the corner post of the footboard FIG. 36.
Figures 39, 40, 41, 42, 43:
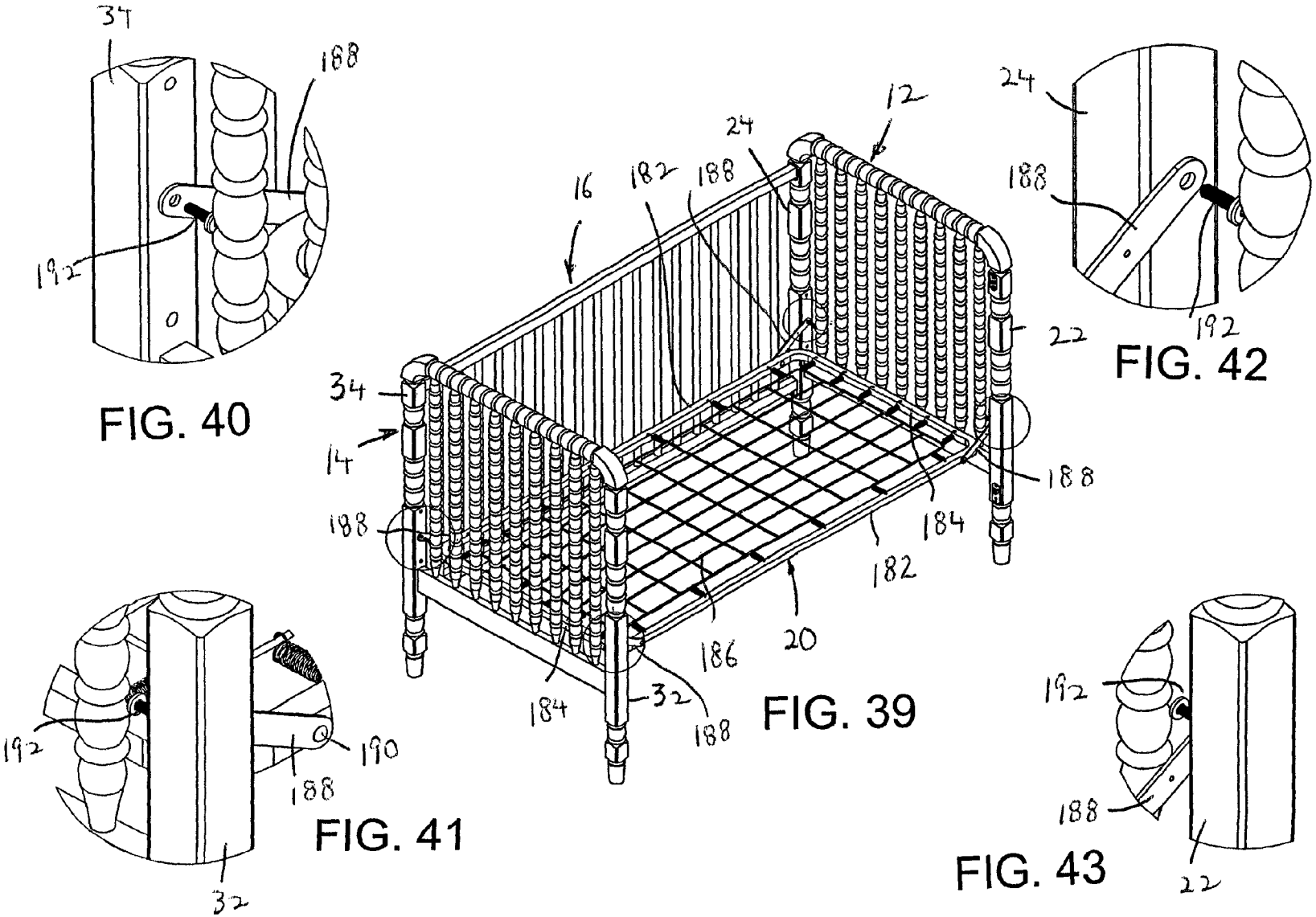
FIG. 39 is a perspective view of the crib of FIG. 36 in a fifth step of assembly, showing the spring deck for supporting a mattress, assembled therewith.
FIG. 40 is an enlarged perspective view showing a first corner of the spring deck being secured to a corner post of the footboard.
FIG. 41 is an enlarged perspective view showing a second corner of the spring deck being secured to the other corner post of the footboard.
FIG. 42 is an enlarged perspective view showing a first corner of the spring deck being secured to a corner post of the headboard.
FIG. 43 is an enlarged perspective view showing a second corner of the spring deck being secured to the other corner post of the headboard.

In operation, when stationary side rails 16, 18 are pivoted down to the vertical position, as previously described, and as shown in FIGS. 29-31, the pivot pin 150 on each side of the respective lower rail member 44, 50 is inserted on each side in the pivot opening 136 of the respective female plate 120. At the same time, stem 168 and enlarged head 170 are inserted through enlarged opening 134 at the upper end of arcuate slot 132. In this position, each swivel plate 162 is oriented horizontally, as shown in FIGS. 32, 34 and 35. A person then grasps each finger grip 172 and rotates swivel plate 162 downwardly into alignment with female plate 120, as shown in FIGS. 36-38. When button 178 hits against the side edge of the respective corner post, it is biased inwardly against the force of bent spring 174, until swivel plate 162 reaches the position where button 178 is in alignment with lower lock opening 138. In this position, button 178 is no longer restrained, and bent spring 174 biases button 178 into lower lock opening 138 to releasably lock the lower end of the respective stationary side rail 16, 18 to headboard 12 and footboard 14.

To detach the lower end of the respective stationary side rail 16, 18 from headboard 12 and footboard 14, the reverse operation is performed. In such case, a person merely pulls the respective stationary side rail 16, 18 outwardly at the lower end. The pulling force results in button 178 riding out of lower lock opening 138 to allow this operation to occur.

As shown in FIGS. 39-43, after one stationary side rail 16, 18 is secured to headboard 12 and footboard 14, spring deck 20 is secured to the partially assembled crib 10. Spring deck 20 includes a rectangular frame formed by two parallel side bars 182 and two parallel end bars 184, with a mattress support arrangement 186 provided within the interior of the rectangular frame. Four connecting bars 188 are provided, one at end corner of spring deck 20. One end of each connecting bar 188 is pivotally connected by a rivet 190 to an end of a respective side bar 182, while the opposite end of each connecting bar 188 is pivotally connected to an inner face of a respective corner post 22, 24, 32, 34 by bolts 192.

Figure 44:
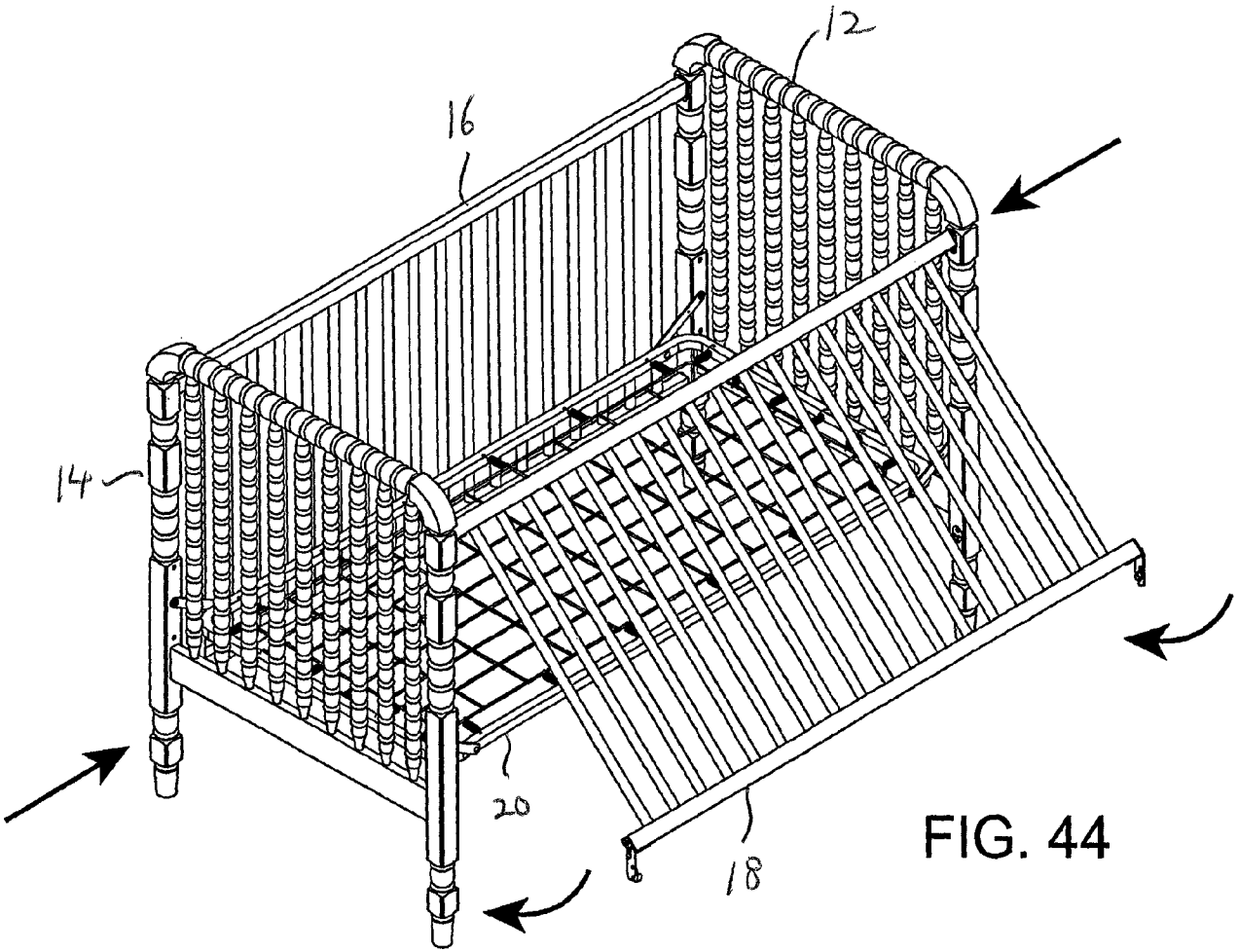
FIG. 44 is a perspective view showing a sixth step of connecting the other stationary side rail to the upper ends of respective corner posts of the headboard and footboard, including engagement of the male and female elements of the key head assembly while the stationary side rail is in a tilted position.

Thereafter, the other stationary side rail 16, 18 on the opposite side of crib 10 is assembled in the same manner, as shown in FIG. 44. Alternatively, a drop side rail can be assembled with headboard 12 and footboard 14.

It will therefore be appreciated that the present invention provides a safe, secure and foolproof way of assembling the stationary side rails 16, 18, without the use of any tools.

It will be appreciated that, while the present invention has been discussed with respect to keyed pivot lock hardware 60 at the upper end of the stationary side rail 16, 18 and swivel lock hardware 62 at the lower end of the stationary side rail 16, 18, the present invention is not so limited.

For example, keyed pivot lock hardware 60 can be provided at the lower end of the stationary side rail 16, 18 and swivel lock hardware 62 at the upper end of the stationary side rail 16, 18.

As a further alternative, keyed pivot lock hardware 60 can be provided at the upper end of the stationary side rail 16, 18, and the lower end can be secured in a conventional manner by screws. As a further alternative, swivel lock hardware 62 can be provided at the upper end of the stationary side rail 16, 18, and the lower end can be secured in a conventional manner by screws. As a still further alternative, swivel lock hardware 62 can be provided at the upper and lower ends of the stationary side rail 16, 18.

Still further, it will be appreciated that the parts of the present invention can be reversed. For example, female plates 64 can be provided on stationary side rails 16, 18, and male key head assemblies 80 can be provided on corner posts 22, 24, 32, 34. In like manner, female plates 120 can be provided on stationary side rails 16, 18, and male key head assemblies 140 can be provided on corner posts 22, 24, 32, 34.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A crib comprising:

a headboard having a pair of spaced apart corner posts;

a footboard having a pair of spaced apart corner posts;

a first stationary side rail connected between a first one of said corner posts of said headboard and a first one of said corner posts of said footboard, said first stationary side rail including an upper rail member and a lower rail member;

a second side rail connected between a second one of said corner posts of said headboard and a second one of said corner posts of said footboard; and locking hardware for securing at least one of said upper rail member and lower rail member to said first corner posts of said headboard and footboard, said locking hardware including:

a first engagement member at one of:

each end of a respective one of said upper and lower rail members, and respective ones of said corner posts; and a second engagement member at one of the other of:

each end of the respective one of said upper and lower rail members, and the respective ones of said corner posts, and each said second engagement member being pivotally movable relative to a respective said first engagement member when said second engagement member is engaged with the respective said first engagement member, to releasably lock said first stationary side rail relative to said headboard and footboard.

2. A crib according to claim 1, wherein said locking hardware includes pivot lock hardware which permits pivotal movement of said first stationary side rail relative to said headboard and footboard and which releasably locks said first stationary side rail relative to said headboard and footboard when said first stationary side rail, headboard and footboard are all in a vertical orientation.

3. A crib according to claim 2, wherein said first engagement member includes a plate having a keyed guide, and said second engagement member includes a male key head assembly which engages with said keyed guide.

4. A crib according to claim 3, wherein said keyed guide includes a keyed female opening in said plate, and said male key head assembly engages within said keyed female opening.

5. A crib comprising:

a headboard having a pair of spaced apart corner posts;

a footboard having a pair of spaced apart corner posts;

a first stationary side rail connected between a first one of said corner posts of said headboard and a first one of said corner posts of said footboard, said first stationary side rail including an upper rail member and a lower rail member;

a second side rail connected between a second one of said corner posts of said headboard and a second one of said corner posts of said footboard; and locking hardware for securing at least one of said upper rail member and lower rail member to said first corner posts of said headboard and footboard, said locking hardware including:

a first engagement member at one of:

each end of a respective one of said upper and lower rail members, and respective ones of said corner posts; and a second engagement member at one of the other of:

each end of the respective one of said upper and lower rail members, and the respective ones of said corner posts, and each said second engagement member being pivotally engaged with a respective said first engagement member to releasably lock said first stationary side rail relative to said headboard and footboard; and wherein said locking hardware includes pivot lock hardware which permits pivotal movement of said first stationary side rail relative to said headboard and footboard and which releasably locks said first stationary side rail relative to said headboard and footboard when said stationary rail, headboard and footboard are all in a vertical orientation;

said first engagement member includes a plate having a keyed guide, and said second engagement member includes a male key head assembly which engages with said keyed guide;

said keyed female opening includes a central opening in said plate and at least one wing opening in said plate in communication with said central opening; and said male key head assembly includes a main body member for rotatably engaging within said central opening and at least one wing member connected with said main body member for engaging within said wing opening to a position behind said plate to permit said pivotal movement of said first stationary side rail relative to said headboard and footboard and to releasably lock said first stationary side rail relative to said headboard and footboard when said stationary rail, headboard and footboard are all in a vertical orientation.

6. A crib according to claim 5, wherein said second engagement member includes a securing member for securing said main body and said at least one wing member to each end of a respective one of said upper and lower rail members, and said plate is secured to the respective ones of said corner posts in covering relation to a bore in the respective ones of said corner posts.

7. A crib according to claim 5, wherein there are two diametrically opposite said wing openings and two diametrically opposite said wing members.

8. A crib according to claim 5, wherein:

said at least one wing opening is oriented at a first angle with respect to a lengthwise direction of said corner posts when said stationary rail, headboard and footboard are all in a vertical orientation; and said at least one wing member is oriented at a second angle different from said first angle when said stationary rail, headboard and footboard are all in a vertical orientation.

9. A crib comprising:

a headboard having a pair of spaced apart corner posts;

a footboard having a pair of spaced apart corner posts;

a first stationary side rail connected between a first one of said corner posts of said headboard and a first one of said corner posts of said footboard, said first stationary side rail including an upper rail member and a lower rail member;

a second side rail connected between a second one of said corner posts of said headboard and a second one of said corner posts of said footboard; and locking hardware for securing at least one of said upper rail member and lower rail member to said first corner posts of said headboard and footboard, said locking hardware including:

a first engagement member at one of:

each end of a respective one of said upper and lower rail members, and respective ones of said corner posts; and a second engagement member at one of the other of:

each end of the respective one of said upper and lower rail members, and the respective ones of said corner posts, and each said second engagement member being pivotally engaged with a respective said first engagement member to releasably lock said first stationary side rail relative to said headboard and footboard; and wherein said locking hardware includes swivel lock hardware, said first engagement member including a plate having an arcuate guide, and said second engagement member including a male key head assembly pivotally mounted relative to said one of the other of each end of the respective one of said upper and lower rail members, and the respective ones of said corner posts, the male key head assembly including a pivotal engagement member which engages in a first initial position with said arcuate guide when said first and second engagement members are initially engaged, and which engages in a second locking position with said arcuate guide when said male key head assembly is pivotally moved relative to said one of the other of:

each end of the respective one of said upper and lower rail members, and the respective ones of said corner posts, to releasably lock said first stationary side rail to the headboard and footboard.

10. A crib according to claim 9, wherein said arcuate guide includes a female plate having an arcuate slot with an enlarged opening at one portion thereof corresponding to said first initial position, and said pivotal engagement member includes a swivel plate pivotally mounted to said one of the other of:

each end of the respective one of said upper and lower rail members, and the respective ones of said corner posts, and having a pin with an enlarged head that fits within said arcuate slot and extends behind said female plate.

11. A crib according to claim 10, wherein said female plate includes a pivot opening adjacent said enlarged opening, and said pivotal engagement member includes a pivot pin that extends through said pivot opening and about which said pivotal engagement member is pivoted relative to said one of the other of:

each end of the respective one of said upper and lower rail members, and the respective ones of said corner posts.

12. A crib according to claim 10, wherein said female plate includes a locking opening, and said pivotal engagement member includes a spring biased button for releasably engaging within said locking opening in said second locking position.

13. A crib according to claim 10, further including a finger grasp member connected with said swivel plate to enable said pivoting movement of said swivel plate.

14. A crib comprising:

a headboard having a pair of spaced apart corner posts;

a footboard having a pair of spaced apart corner posts;

a first stationary side rail connected between a first one of said corner posts of said headboard and a first one of said corner posts of said footboard, said first stationary side rail including an upper rail member and a lower rail member;

a second side rail connected between a second one of said corner posts of said headboard and a second one of said corner posts of said footboard;

pivot lock hardware for securing one of said upper rail member and lower rail member to said first corner posts of said headboard and footboard, said pivot locking hardware including:

a first engagement member at one of:

each end of a respective one of said upper and lower rail members, and respective ones of said corner posts; and a second engagement member at one of the other of:

each end of the respective one of said upper and lower rail members, and the respective ones of said corner posts, and each said second engagement member being pivotally engaged with a respective said first engagement member to permit pivotal movement of said first stationary side rail relative to said headboard and footboard and to releasably lock said first stationary side rail relative to said headboard and footboard when said stationary rail, headboard and footboard are all in a vertical orientation; and swivel lock hardware for securing the other of said upper rail member and lower rail member to said first corner posts of said headboard and footboard, said swivel lock hardware including:

a third engagement member at one of:

each end of a respective other of said upper and lower rail members, and respective ones of said corner posts; and a fourth engagement member at one of the other of:

each end of the respective other of said upper and lower rail members, and the respective ones of said corner posts, and each said fourth engagement member being pivotally engaged with a respective said third engagement member to releasably lock said first stationary side rail relative to said headboard and footboard.

15. A crib according to claim 14, wherein said first engagement member includes a plate having a keyed guide, and said second engagement member includes a male key head assembly which engages with said keyed guide.

16. A crib according to claim 15, wherein said keyed guide includes a keyed female opening in said plate, and said male key head assembly engages within said keyed female opening.

17. A crib according to claim 15, wherein:

said keyed female opening includes a central opening in said plate and at least one wing opening in said plate in communication with said central opening; and said male key head assembly includes a main body member for rotatably engaging within said central opening and at least one wing member connected with said main body member for engaging within said wing opening to a position behind said plate to permit said pivotal movement of said first stationary side rail relative to said headboard and footboard and to releasably lock said first stationary side rail relative to said headboard and footboard when said stationary rail, headboard and footboard are all in a vertical orientation.

18. A crib according to claim 17, wherein said second engagement member includes a securing member for securing said main body and said at least one wing member to each end of a respective one of said upper and lower rail members, and said plate is secured to the respective ones of said corner posts in covering relation to a bore in the respective ones of said corner posts.

19. A crib according to claim 17, wherein there are two diametrically opposite said wing openings and two diametrically opposite said wing members.

20. A crib according to claim 17, wherein said at least one wing opening and said at least one wing member are oriented at different angles relative to each other when said stationary rail, headboard and footboard are all in a vertical orientation.

21. A crib according to claim 14, wherein:

said third engagement member includes a plate having an arcuate guide, and said fourth engagement member includes a male key head assembly pivotally mounted relative to one of the other of:

each end of the respective other of said upper and lower rail members, and the respective ones of said corner posts, the male key head assembly includes a pivotal engagement member which engages in a first initial position with said arcuate guide when said first and second engagement members are initially engaged, and which engages in a second locking position with said arcuate guide when said male key head assembly is pivotally moved relative to the other of said one of each end of the respective others of said upper and lower rail members, and the respective ones of said corner posts, to lock said first stationary side rail to the headboard and footboard.

22. A crib according to claim 21, wherein said arcuate guide includes a female plate having an arcuate slot with an enlarged opening at one portion thereof corresponding to said first initial position, and said pivotal engagement member includes a swivel plate pivotally mounted to the other of said one of each end of the respective other of said upper and lower rail members, and the respective ones of said corner posts and having a pin with an enlarged head that fits within said arcuate slot and extends behind said female plate.

23. A crib according to claim 22, wherein said female plate includes a pivot opening adjacent said enlarged opening, and said pivotal engagement member includes a pivot pin that extends through said pivot opening and about which said pivotal engagement member is pivoted relative to the other of said one of each end of the respective other of said upper and lower rail members, and the respective ones of said corner posts.

24. A crib according to claim 22, wherein said female plate includes a locking opening, and said pivotal engagement member includes a spring biased button for releasably engaging within said locking opening in said second locking position.

25. A crib according to claim 22, further including a finger grasp member connected with said swivel plate to enable said pivoting movement of said swivel plate.

* * * * *